US008750540B2

(12) United States Patent
Tan

(10) Patent No.: US 8,750,540 B2
(45) Date of Patent: Jun. 10, 2014

(54) OMNIDIRECTIONAL SPEAKER

(75) Inventor: Kok Leong Tan, Cherry Hill (SG)

(73) Assignee: Dream Audiolab Pte. Ltd., Singapore (SG)

( * ) Notice: Subject to any disclaimer, the term of this patent is extended or adjusted under 35 U.S.C. 154(b) by 29 days.

(21) Appl. No.: 13/502,422

(22) PCT Filed: Oct. 14, 2010

(86) PCT No.: PCT/SG2010/000393

§ 371 (c)(1),
(2), (4) Date: Apr. 17, 2012

(87) PCT Pub. No.: WO2011/053248

PCT Pub. Date: May 5, 2011

(65) Prior Publication Data

US 2012/0201403 A1 Aug. 9, 2012

(30) Foreign Application Priority Data

Oct. 30, 2009 (SG) ..... 200907238-0

(51) Int. Cl.
*H04R 1/32* (2006.01)
*H04R 1/34* (2006.01)

(52) U.S. Cl.
CPC ..... *H04R 1/323* (2013.01); *H04R 1/345* (2013.01)
USPC ..... 381/182; 381/160; 381/337; 381/184; 381/186; 181/144; 181/147; 181/155

(58) Field of Classification Search
CPC ..... H04R 1/24; H04R 1/32; H04R 1/323; H04R 1/345; H04R 1/40; H04R 1/403; H04R 1/405; H04R 5/02; H04R 2201/40; H04R 2201/403; H04R 2201/405
USPC ..... 381/160, 339, 342, 351, 352, 337, 184, 381/186, 386, 387; 181/144, 147, 155
See application file for complete search history.

(56) References Cited

U.S. PATENT DOCUMENTS 3,816,672 A * 6/1974 Gefvert et al. ..... 381/352
3,898,384 A * 8/1975 Goeckel ..... 381/342

(Continued)

FOREIGN PATENT DOCUMENTS

EP 0390123 A2 10/1990

OTHER PUBLICATIONS

International Search Report dated Jan. 4, 2011 corresponding to International Patent Application No. PCT/SG2010/000393.

(Continued)

*Primary Examiner* — Curtis Kuntz
*Assistant Examiner* — Joshua A Kaufman
(74) *Attorney, Agent, or Firm* — Ohlandt, Greeley, Ruggiero & Perle, LLP

(57) ABSTRACT

An omnidirectional speaker having a high frequency driver, which generates sound over a high frequency range and which has a first diameter, and a high frequency waveguide having a second diameter larger than the first diameter. A first midrange driver and a second midrange driver have a third diameter and a fourth diameter, respectively. Each midrange driver generates sound over a middle frequency range and the first midrange driver faces the second midrange driver. First and second midrange waveguides have a fifth diameter and a sixth diameter, respectively, and correspond to the first and second midrange drivers, respectively. The fifth diameter is larger than the third diameter and the sixth diameter is larger than the fourth diameter. Both of the midrange frequency waveguides are positioned between the first midrange driver and the second midrange driver so as to block a direct path from the first midrange driver to the second midrange driver.

12 Claims, 5 Drawing Sheets

(56) References Cited

U.S. PATENT DOCUMENTS

| | | | | | |
|---|---|---|---|---|---|
| 4,182,931 | A | * | 1/1980 | Kenner | 381/89 |
| 4,200,170 | A | * | 4/1980 | Williams, Jr. | 181/155 |
| 4,348,549 | A | * | 9/1982 | Berlant | 381/99 |
| 4,850,452 | A | * | 7/1989 | Wolcott | 181/144 |
| 4,923,031 | A | * | 5/1990 | Carlson | 181/144 |
| 5,115,882 | A | | 5/1992 | Woody | |
| 5,164,549 | A | * | 11/1992 | Wolf | 181/147 |
| 5,306,880 | A | * | 4/1994 | Coziar et al. | 181/149 |
| 5,673,329 | A | | 9/1997 | Wiener | |
| 5,847,331 | A | | 12/1998 | Vollmer et al. | |
| 7,577,265 | B2 | * | 8/2009 | Pazandeh | 381/160 |

OTHER PUBLICATIONS

European Office Action dated Feb. 24, 2014 corresponding to European Patent No. 10827252.7, 4 pp.

* cited by examiner

OMNIDIRECTIONAL SPEAKER

FIELD OF THE INVENTION

This invention relates to omnidirectional speakers, and more particularly to an omnidirectional speaker with improved sound quality.

BACKGROUND OF THE INVENTION

Drivers are transducers which convert electricity to various ranges of sound frequencies. It has been known for many years to provide speakers having a plurality of drivers generating sounds of varying audible frequencies. Such speakers are sometimes referred to as multiway loudspeakers. Drivers include a diaphragm that moves back and forth to create pressure waves in a column of air in front of the driver, and depending on the application, at some angle to the sides. The diaphragm is typically in the shape of a cone and has a diameter. The use of multiple drivers is done in an effort to enhance sound quality. The combinations typically take on the form of woofers (or sub-woofers) for emitting sounds in a low frequency range, midrange drivers for emitting sound in a middle range, and tweeters for emitting sounds in a high frequency range. Breaking up a sound signal in this manner has been found to advantageously cover the range of sounds a human can hear. The multiple drivers may be mounted coaxially normal to a floor or ground. Such speakers are known as omindirectional speakers, and they provide a sound field which allows a person positioned in any direction around the speaker to hear the wide bandwidth (frequency range) sound produced by the speaker.

A wide variety of speaker designs have been created in an effort to enhance sound quality. For example, known speaker designs include U.S. Pat. No. 5,115,882 to Woody. Woody discloses a speaker comprising a pair of drivers, one tweeter and one midrange, with each driver aligned in the same direction. Each driver is also provided with a conical shaped dispersion surfaces. However, irregular surfaces, such as the tip of the conical shaped dispersion surface, have been found to introduce distortions in sound quality. Such conical shaped waveguides have proved to be less than ideal. In general, irregular surfaces produce reflections in sound waves which are out of phase with other sound waves generated by the speaker, and can also result in reinforcement of some frequencies and cancellation of others.

U.S. Pat. No. 4,182,931 to Kenner discloses a pair of drivers which are coaxial and face each other, and each driver is provided with a dome (waveguide). However, the diameter of the domes/waveguides is less than the diameter of the drivers, and the domes/waveguides have a flat reflecting surface. This has the effect of introducing distortions in sound quality. Another known speaker design has a coaxial tweeter, a trapezoidal midrange driver and subwoofer. A waveguide is positioned above the tweeter, and another generally spherical shaped waveguide is positioned between the tweeter and the midrange driver. However, the spherically shaped waveguide is smaller than the midrange driver, again resulting in some distortions in the sound quality. An idealized omindirectional speaker would reproduce sound at a point, and the sound would radiate outward from the point all directions. Sound waves diverging would be free of interferences. It would be desirable to provide an omnidirectional speaker with a plurality of drivers which provides enhanced sound quality, which reduces background noises and distortions, and which is therefore more faithful to an original recording.

SUMMARY OF THE INVENTION

In accordance with a first aspect, an omindirectional speaker comprises a high frequency driver which generates sound over a high frequency range and has a first diameter, and a high frequency waveguide having a second diameter which is larger than the first diameter. A first midrange driver has a third diameter and a second midrange driver has a fourth diameter. Each midrange driver generates sound over a middle frequency range and the first midrange driver faces the second midrange driver. A first midrange waveguide corresponds to the first midrange driver and has a fifth diameter, and a second midrange waveguide corresponds to the second midrange driver and has a sixth diameter. The fifth diameter is larger than the third diameter and the sixth diameter is larger than the fourth diameter, and both of the midrange frequency waveguides are positioned between the first midrange driver and the second midrange driver so as to block a direct path from the first midrange driver to the second midrange driver.

From the foregoing disclosure and the following more detailed description of various embodiments it will be apparent to .those skilled in the art that the present invention provides a significant advance in the technology of speakers. Particularly significant in this regard is the potential the invention affords for providing a high quality, low cost omindirectional speaker. Additional features and advantages of various embodiments will be better understood in view of the detailed description provided below.

Figure 1:
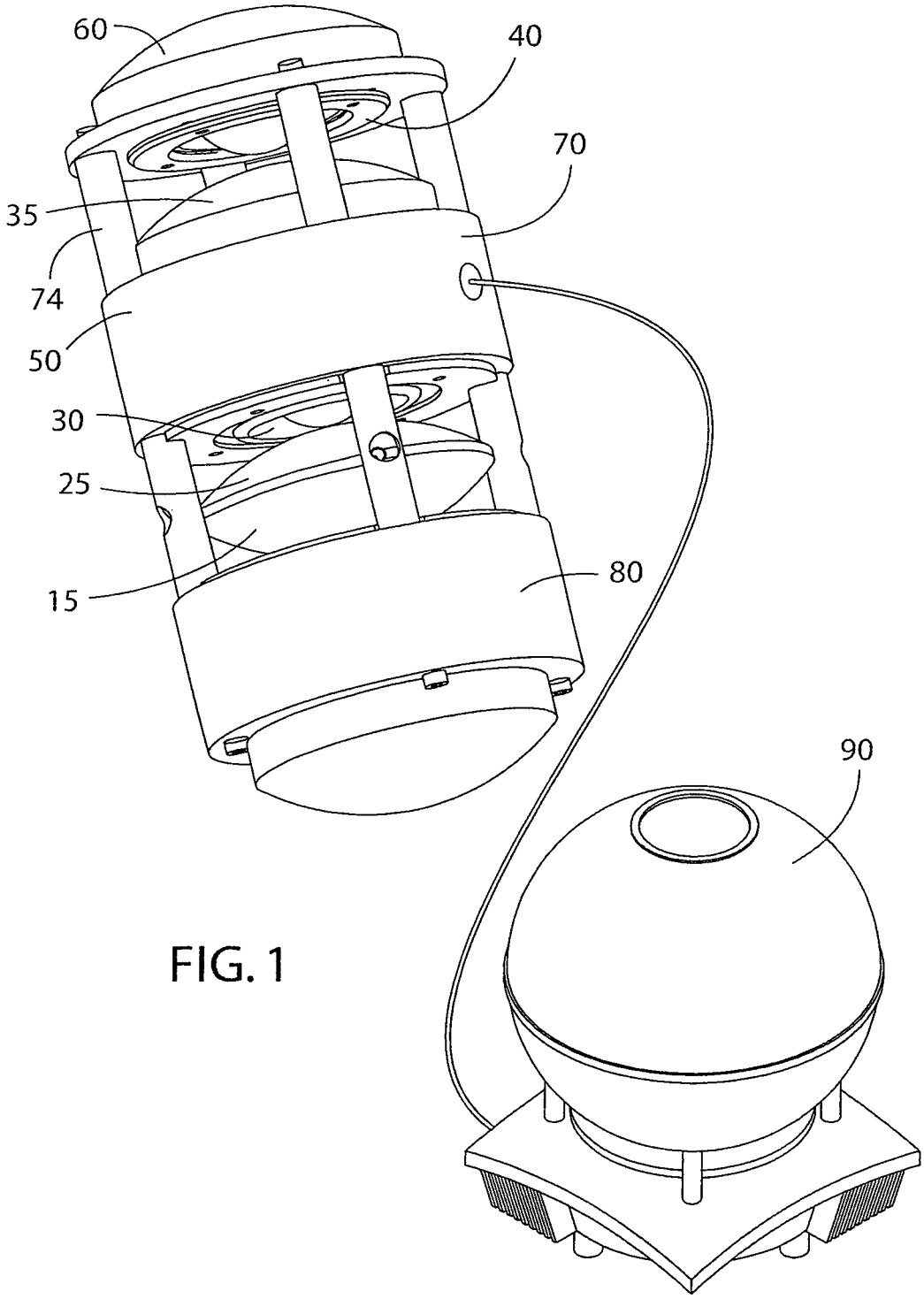
FIG. 1 is an isometric view of one embodiment of an omindirectional speaker having a woofer, a tweeter, and a pair of midrange drivers, with the tweeter and midrange drivers provided with convex waveguides.

It should be understood that the appended drawings are not necessarily to scale, presenting a somewhat simplified representation of various features illustrative of the basic principles of the invention. The specific design features of the omindirectional speaker as disclosed here, including, for example, the specific dimensions of the waveguides, will be determined in part by the particular intended application and use environment. Certain features of the illustrated embodiments have been enlarged or distorted relative to others to help provide clear understanding. In particular, thin features may be thickened, for example, for clarity of illustration. All references to direction and position, unless otherwise indicated, refer to the orientation illustrated in the drawings.

DETAILED DESCRIPTION OF CERTAIN EMBODIMENTS

It will be apparent to those skilled in the art, that is, to those who have knowledge or experience in this area of technology, that many uses and design variations are possible for the omindirectional speakers disclosed here. The following detailed discussion of various alternate features and embodiments will illustrate the general principles of the invention with reference to an omindirectional speaker suitable for use in home entertainment systems. Other embodiments suitable for other applications will be apparent to those skilled in the art given the benefit of this disclosure.

Turning now to the drawings, FIGS. 1-4 show a speaker 10 in accordance with one embodiment having multiple drivers 20, 30, 40 and 90. Each driver converts electricity into sound over a given range of frequencies. For example, a tweeter or high frequency driver 40 may generate sound over a range of 3000 Hz to 32 KHz, for example. A midrange driver may generate sound over a range of 160 Hz to 8000 KHz, for example. A. woofer or low frequency driver may generate sound over a range of 20 Hz to 160 Hz, for example. In the embodiments shown in the Figs., the tweeter or high frequency driver 40 is positioned in and affixed to a frame 50, along with a pair of midrange drivers 20, 30. The frame 50 comprises portions 60, 70, 80 which act as a housing to position and align the drivers. Given the nature and energy of low audible frequencies, woofer 90 or low frequency range driver may be positioned within the frame or separate from the frame, as desired. Generally, all the frequencies are in a range audible by humans, and the frequency ranges or the tweeter, midrange drivers and woofers may overlap somewhat. Also, the midrange drivers may be formed as a combination of midrange and woofer drivers, instead of three separate drivers. All of the drivers are electrically connected together so as to broadcast simultaneously.

Figure 2:
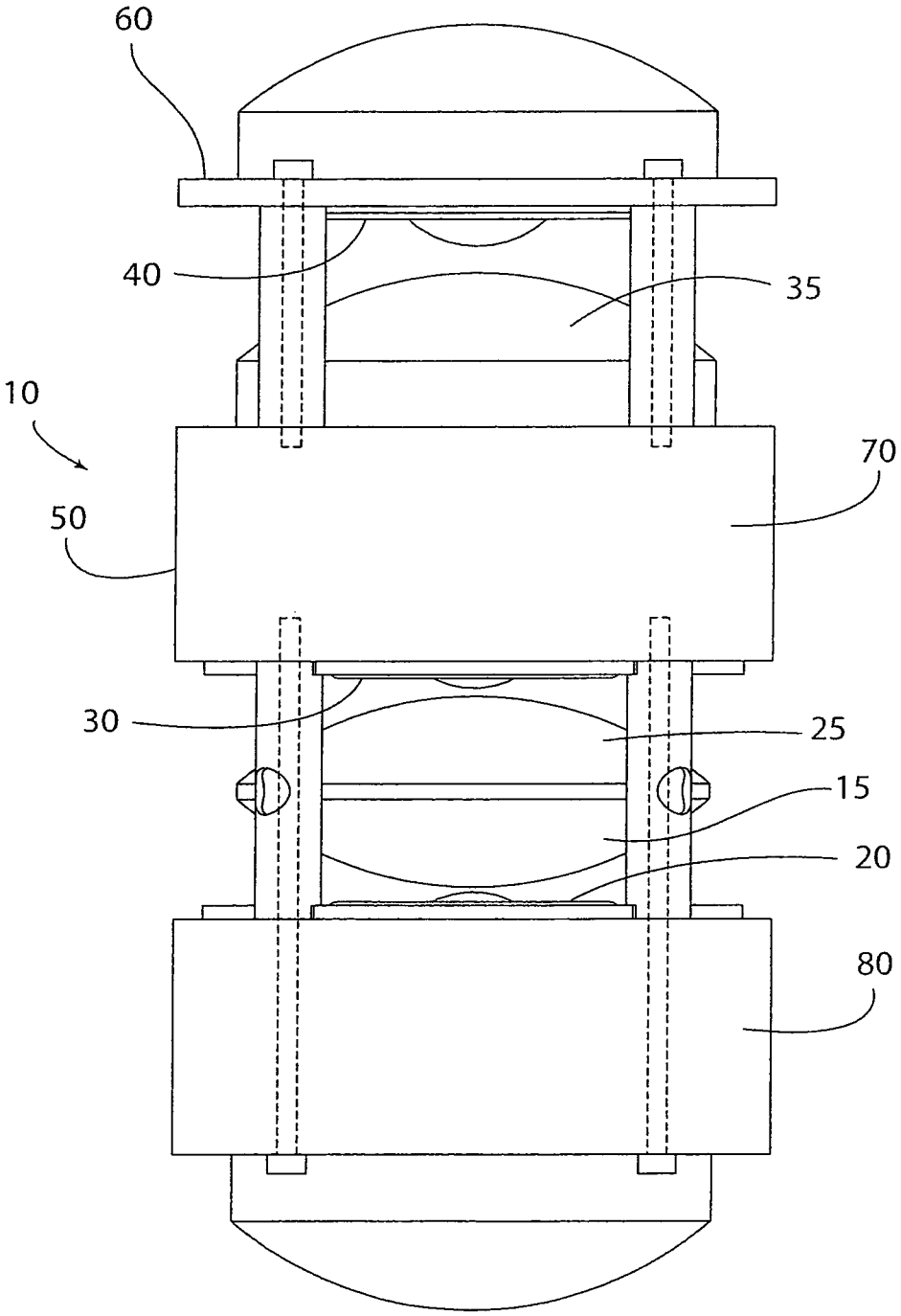
FIG. 2 is a side view of the omindirectional speaker of FIG. 1.

FIG. 2 shows the tweeter 40 and pair of midrange drivers 20, 30. In accordance with a highly advantageous feature, sound is reflected from each driver out to listeners by a corresponding waveguide. High frequency waveguide 35 corresponds to high frequency driver 40; first midrange waveguide 15 corresponds to first midrange driver 20 and second midrange waveguide corresponds to second midrange drivers 30. Optionally, the woofer may also be provided with a similar waveguide. However, given the energy of sound vibration at lower frequencies, such a waveguide is not needed for the woofer. Each waveguide 15, 25, 35 can have a generally circular cross section when viewed from above (or below), which corresponds to the generally circular shape of each driver.

Figure 3:
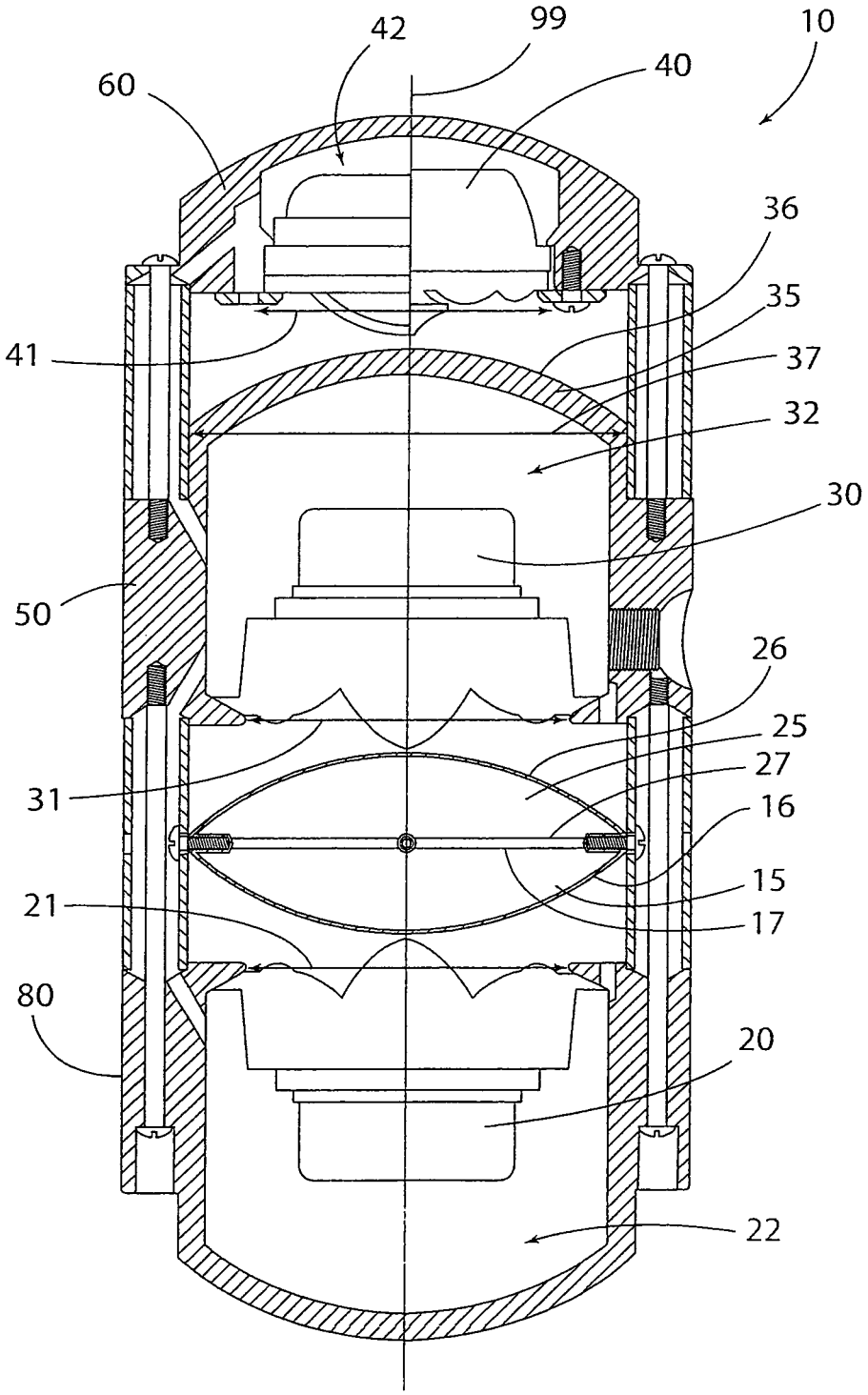
FIG. 3 is a cross section view of the omindirectional speaker of FIG. 1.

FIG. 3 is a cross section view which shows the bottom mounting cap or portion 80 cooperating with the first midrange driver 20 to define a first back chamber 22. Back chambers accommodate movement of the corresponding driver as a result of vibration from sound generation. In a similar manner, a second back chamber 32 is defined by the second midrange driver 30 in cooperation with the frame 50 and the high frequency waveguide 35. A top mounting cap or portion 60 cooperates with the tweeter 40 to define a third back chamber 42. Optionally, each of the chambers 22, 32, 42 may be filled with a sound absorbing material. It is preferable that the closest distance between the waveguide and the corresponding driver be no more than 10 mm, and more preferably, no more than 5 mm. The closest distance, as seen in FIG. 3, would be at a line along axis 99.

Although the surfaces 16, 26, 36 of the waveguides 15, 25, 35 are referred to herein as either convex (as shown in FIGS. 1-4) or dual hyperbolic, the surfaces 16, 26, and 36 of the waveguides are understood not necessarily to be limited to the precise mathematical description of such geometries. The waveguide surfaces which reflect sound generated from the drivers merely approximates these shapes, as seen in the Figs. It has been found to be more important that the surfaces be smooth and free of irregularities, discontinuities and/or abrupt transitions, and that the diameter of the driver which generates the sound reflected to the corresponding waveguide be less than the diameter of the waveguide. Preferably the surfaces 16, 26, 36 of the waveguides are differentiable, i.e., defined entirely from or nearly entirely from a continuous function, such as a parabola, ellipse, etc. Such differentiable surfaces may have a non-continuous slope to avoid an abrupt transition at axis 99. This avoids irregular surfaces, points, etc., which would introduce distortions into the sound. Other smooth surfaces and geometries suitable for use as a waveguide will be readily apparent to those skilled in the art given the benefit of this disclosure.

In accordance with a highly advantageous feature, a pair of midrange frequency drivers 20, 30 are also positioned in the frame 50 facing each other. Positioned between the midrange drivers 20, 30 are corresponding midrange frequency waveguides 15, 25 so as to block a direct path from the first midrange driver 20 to the second midrange driver 30, as shown in FIG. 3. Each of the drivers 20, 30, and 40 has a center, and preferably the centers of each driver are aligned with one another, such as at axis 99. The high frequency driver 40 has a first diameter 41. The high frequency waveguide 35 has a second diameter 37 which is larger than the first diameter 41. The first midrange driver 20 has a third diameter 21 and the second midrange driver 30 has a fourth diameter 31. The first midrange waveguide 15 has a fifth diameter 17 which is larger than the third diameter. In a similar manner, the second midrange waveguide 25 has a sixth diameter 27, and the sixth diameter 27 is larger than the fourth diameter 31. Advantageously, the third diameter 21 can be the same as the fourth diameter 31, and the fifth diameter 17 can be the same as the sixth diameter 27, as shown in FIG. 3. The waveguides shown in the Figs. have a circular shape when viewed from above or below (as that term in understood in FIG. 1). Other shapes, such will also serves as a proper waveguide, provided the waveguide has a smooth surface over an area which exceeds an area defined by the diameter of the drivers. Although referred to here as diameters, the lines shown in FIG. 3 are more precisely understood as lengths or the narrowest portion of the waveguide. If the waveguides have an elliptical shape for example, the diameter would be defined along the minor axis of the ellipse.

Figure 4:
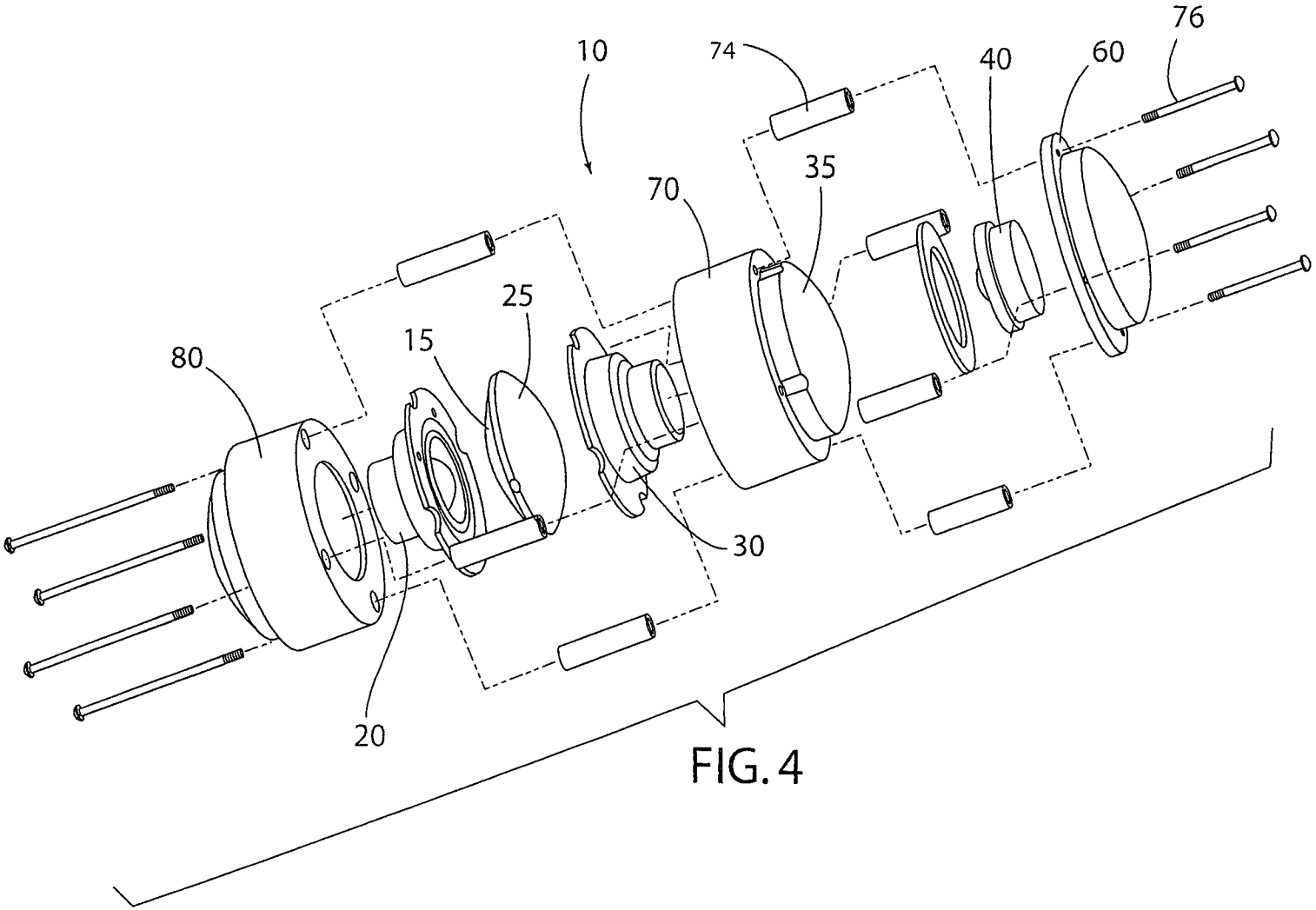
FIG. 4 is an exploded isometric view of the omindirectional speaker of FIG. 1.
Figure 5:
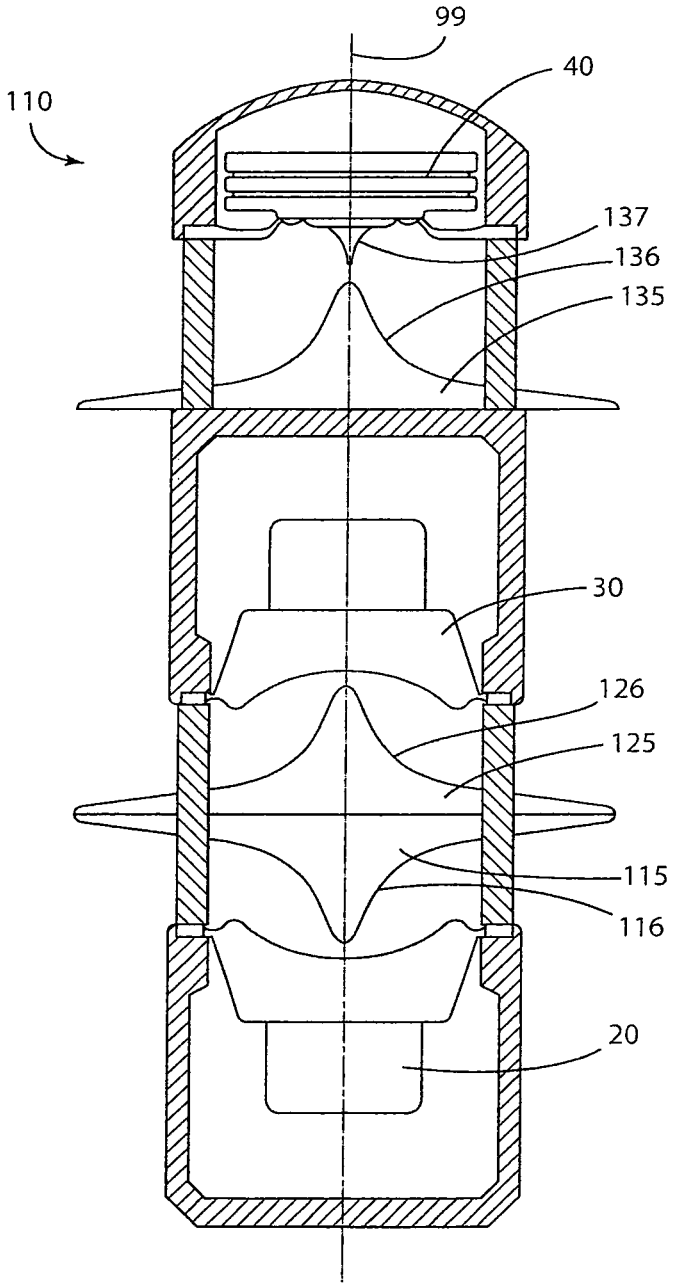
FIG. 5 is a schematic cross section view of another embodiment of an omindirectional speaker using waveguides having an alternate profile.

FIG. 4 is an exploded isometric view of the omindirectional speaker of FIG. 1. The frame 50 comprises portions 60, 70, 80 along with spacing struts 74 and fasteners 76, allowing for assembly into a complete housing. The two waveguides 15 and 25 may be fastened together as shown or formed as a single piece or unitary construction. FIG. 5 shows another embodiment of a speaker 110, wherein each of the waveguides 115, 125, 135 have a corresponding surface 116, 126, 136 with a generally dual hyperbolic shape. As with the first embodiment, each waveguide has a diameter which is greater than the diameter of the corresponding driver. A real waveguide surface cannot exactly match the curve of a hyperbola. Rather, it is more critical that the surface be smooth without rough or irregular transitions which would introduce distortions. In accordance with a highly advantageous feature, the tweeter 40 may be provided with a waveguide projection 137 directly opposite the high frequency waveguide 135. Waveguide projection cooperates with the waveguide 135 to reflect sound from the driver 40. Optionally, if desired a waveguide projection may also be positioned on the midrange drivers 20 and 30. As with the first embodiment, it is preferable that the closest distance between the waveguide and the corresponding driver (or in the case of the tweeter 40 shown in FIG. 5, the waveguide 135 and the waveguide projection 137) be no more than 10 mm, and more preferably, no more than 5 mm.

From the foregoing disclosure and detailed description of certain embodiments, it will be apparent that various modifications, additions and other alternative embodiments are possible without departing from the true scope and spirit of the invention. The embodiments discussed were chosen and described to provide the best illustration of the principles of the invention and its practical application to thereby enable one of ordinary skill in the art to use the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. An omnidirectional speaker comprising, in combination:

a high frequency driver which generates sound over a high frequency range and has a first diameter;

a high frequency waveguide having a second diameter which is larger than the first diameter;

a first midrange driver having a third diameter and a second midrange driver having a fourth diameter, wherein each midrange driver generates sound over a middle frequency range and the first midrange driver faces the second midrange driver;

a first midrange waveguide corresponding to the first midrange driver and having a fifth diameter; and a second midrange waveguide corresponding to the second midrange driver and having a sixth diameter, wherein the fifth diameter is larger than the third diameter and the sixth diameter is larger than the fourth diameter;

wherein both of the midrange frequency waveguides are positioned between the first midrange driver and the second midrange driver so as to block a direct path from the first midrange driver to the second midrange driver, and the midrange waveguides have a differentiable surface.

2. The omnidirectional speaker of claim 1 wherein the surface of each midrange waveguide is convex.

3. The omnidirectional speaker of claim 1 wherein each of the drivers has a center, and all of the centers are co-axial with one another.

4. The omnidirectional speaker of claim 1 wherein a closest distance between each waveguide and the corresponding driver is less than 10 mm.

5. The omnidirectional speaker of claim 1 wherein the third diameter is the same as the fourth diameter and the fifth diameter is the same as the sixth diameter.

6. The omnidirectional speaker of claim 1 further comprising a low frequency range driver.

7. The omnidirectional speaker of claim 1 further comprising a housing, wherein at least the high frequency driver, the first midrange driver and the second midrange driver are affixed to the housing.

8. The omnidirectional speaker of claim 7 wherein the housing and one of the midrange drivers cooperate to define a first back chamber.

9. The omnidirectional speaker of claim 7 wherein the housing and the high frequency waveguide cooperate with one of the midrange drivers to define a second back chamber.

10. The omnidirectional speaker of claim 7 wherein the housing and the high frequency driver cooperate to define a third back chamber.

11. The omnidirectional speaker of claim 1 further comprising a waveguide projection affixed to the high frequency driver which cooperates with the high frequency waveguide to reflect sound generated by the high frequency driver.

12. The omnidirectional speaker of claim 1 wherein the surface of each midrange waveguide has a general dual hyperbolic shape with a differentiable apex on each midrange waveguide.

* * * * *